US005841352A

United States Patent [19]

Prakash

[11] Patent Number: 5,841,352

[45] Date of Patent: Nov. 24, 1998

[54] CHILD MONITOR

[76] Inventor: Sushil Prakash, 26941 Patrick Ave., Hayward, Calif. 94544

[21] Appl. No.: 878,220

[22] Filed: Jun. 18, 1997

[51] Int. Cl.[6] ..... G08B 23/00

[52] U.S. Cl. ..... 340/573; 340/539; 340/568; 342/357; 342/450

[58] Field of Search ..... 340/573, 539, 340/568, 571, 531, 572, 825.49; 342/127, 357, 450

[56] References Cited

U.S. PATENT DOCUMENTS

| | | | |
|---|---|---|---|
| 3,922,678 | 11/1975 | Frenkel . | |
| 4,785,291 | 11/1988 | Hawthorne . | |
| 5,021,794 | 6/1991 | Lawrence . | |
| 5,170,172 | 12/1992 | Weinstein | 340/573 |
| 5,289,163 | 2/1994 | Perez et al. . | |
| 5,311,185 | 5/1994 | Hochstein et al. . | |
| 5,343,512 | 8/1994 | Wang et al. . | |
| 5,461,365 | 10/1995 | Schlager et al. . | |
| 5,515,419 | 5/1996 | Sheffer . | |
| 5,589,821 | 12/1996 | Sallen et al. | 340/573 |

*Primary Examiner*—Nina Tong
*Attorney, Agent, or Firm*—Chase & Yakimo, L.C.

[57] ABSTRACT

A monitor system comprises first and second watches for wear by first and second users of the system. Each watch includes a battery therein for powering a transmitter and receiver. A signal limiter provides a base signal to a comparator so that the comparator can compare the base signal to a transmitted signal from one watch as received by the receiver of the other watch. Upon the received signal being less than the base signal, the comparator closes a relay which in turn energizes an alarm. The alarm indicates that an undesired amount of separation has occurred between the two watches. The strength of the signal produced by the signal limiter can be varied such that the desired degree of separation between the watches, which energizes the alarm, can be varied. A panic button is provided so that an alarm in one watch can be energized by the user of another watch irrespective of the distance between watches. The use of the monitor system in a watch-type configuration allows for its unobtrusive use.

7 Claims, 4 Drawing Sheets

CHILD MONITOR

BACKGROUND OF THE INVENTION

This invention relates to a monitor system and, more particularly, to a two-way watch system which consistently monitors the distance between two wearers of watches of the system.

Various types of monitor devices have been proposed which measure the distance between a base station and another monitor, an alarm being sounded at the base station upon the person exceeding a preselected distance. One monitor system is shown in U.S. Pat. No. 5,311,185 to Hochstein et al. Another system is shown in the Schlager patent U.S. Pat. No. 5,461,321 which shows a base station and one or more sensing units for wear by a child, a signal being sounded at the base station upon the child exceeding a certain distance.

Although assumably effective in operation, such devices have been rather cumbersome to wear and may embarrass the child. Moreover, the base station is at a fixed location which constrains the movement of the monitor, such as a parent, to the base station area. Otherwise, any warnings of a wandering child exceeding a certain distance would not be heard.

SUMMARY OF THE INVENTION

In response thereto I have invented a two-way monitoring system in the form of first and second watches, each watch having a transceiver assembly therein in communication with a transceiver assembly in the other watch. Each watch assembly consistently monitors the distance between the other watch assembly. Upon separation of the watch wearers beyond a predetermined distance, an alarm will sound on the watches to indicate that the users have exceeded such distance. Accordingly, a dual alarm is given of such separation while allowing both users to move about. The predetermined distance of separation can be adjusted according to the situation at hand, i.e., a shorter distance may be set in a crowded environment as opposed to a longer distance when in a country environment. Each watch can sound an alarm in the other watch irrespective of the preselected distance being exceeded.

It is therefore a general object of this invention to provide a monitor system which continuously monitors the distance of separation between two mobile users.

Another object of this invention is to provide a system, as aforesaid, which provides transceivers for both users in the form of watches.

A still further object of this invention is to provide a monitor system, as aforesaid, which sounds an alarm at each transceiver upon a preselected distance between the two users being exceeded.

A further object of this invention is to provide a system, as aforesaid, wherein the preselected distance is adjustable.

A still further object of this invention is to provide a system, as aforesaid, which enables one user to provide a signal to the other user irrespective of the preselected distance being exceeded.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
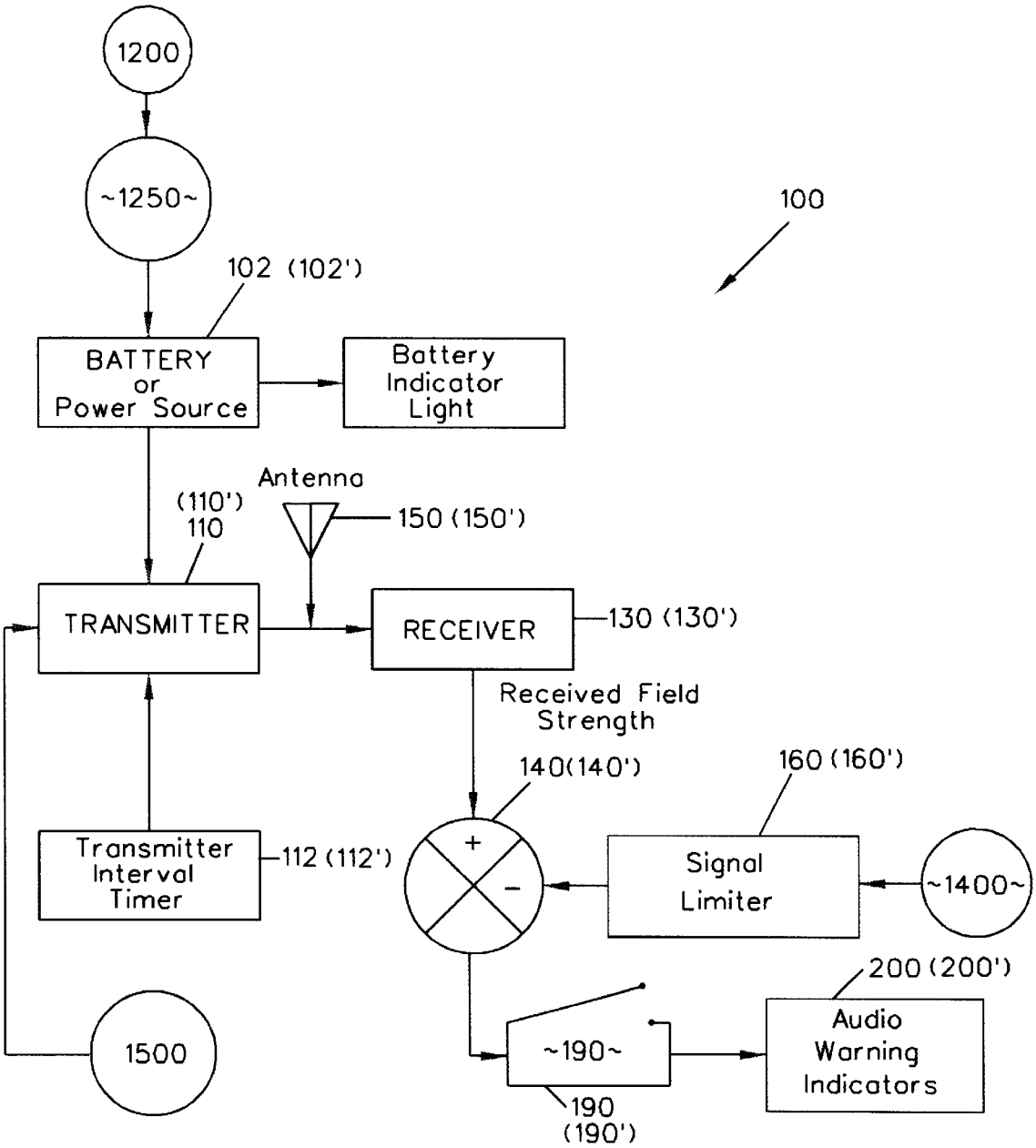
FIG. 1 is a block diagram of one transceiver assembly of the monitor system.
Figure 2:
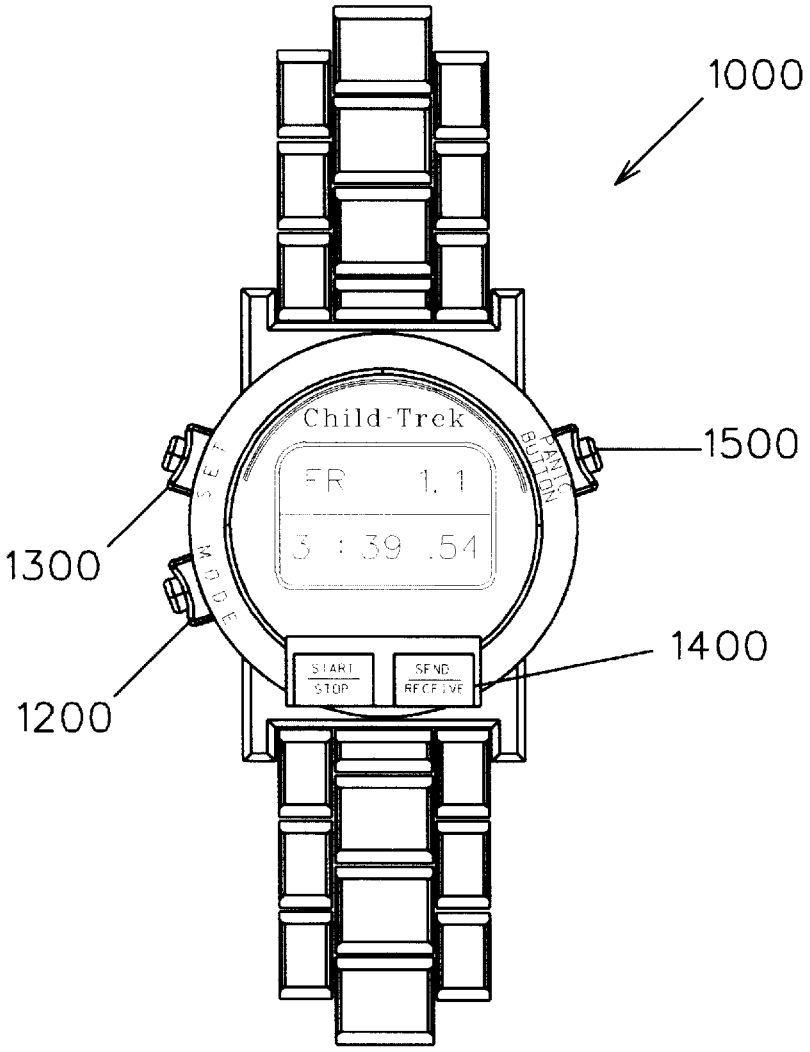
FIG. 2 is a view of one transceiver of the monitor system in the form of a watch, the watch face display being in a time mode.

Turning more particularly to the drawings, FIG. 1 shows a block diagram of one transceiver assembly 100 located in one of the watches 1000 of the user, it being understood that the other watch 1000' will have a similar assembly. This other assembly is referenced herein with identical but primed numbers.

The system includes a battery power source 102 for the transmitter 110, it being understood that the delivery of the battery power to the transmitter 140 may be regulated by depression of the mode button 1200 and start/stop button 1250 on the watch. Battery 102 may also be the battery used to energize the watch. Upon such power delivery the transmitter 110 will transmit signals that will be periodically sent to the receiver 130' of the other transceiver assembly 100' as received by the antenna 150' within watch 1000' proper. An interval timer 112 is provided so as to provide a periodic transmission of such signals.

Upon reception of the signal by the receiver 130' in the other assembly 100', the receiver 130' sends out a signal to a comparator 140'. The comparator 140' compares the received signal to a basic limit signal which has been provided by a signal limiter 160'. The base signal has a strength which corresponds to a strength of a received signal as transmitted at the preselected distance. Thus, the base signal strength decreases as the preselected distance increases. If the actual received signal strength is greater than the base signal, the watches are deemed to be within the preselected distance. If the received signal strength is less than the base signal strength, the watches are deemed to be without the preselected distance. Accordingly, the comparator 140' will deliver a control signal to relay 190 which in turn will sound the alarm 200' on the receiving watch 1000'. This alarm 200' may either be an alarm normally found in the watch or a separate alarm.

Figure 3:
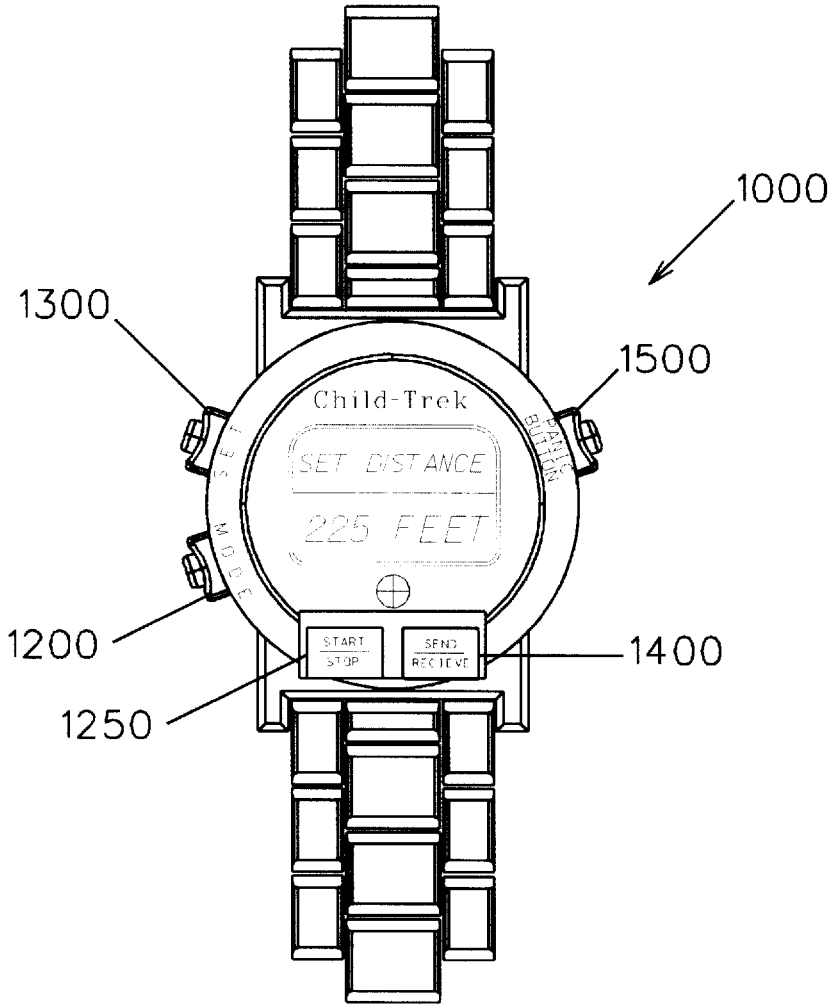
FIG. 3 is a front view of the transceiver in the form of a watch, the watch face display being in a mode showing, the preselected distance of separation.
Figure 4:
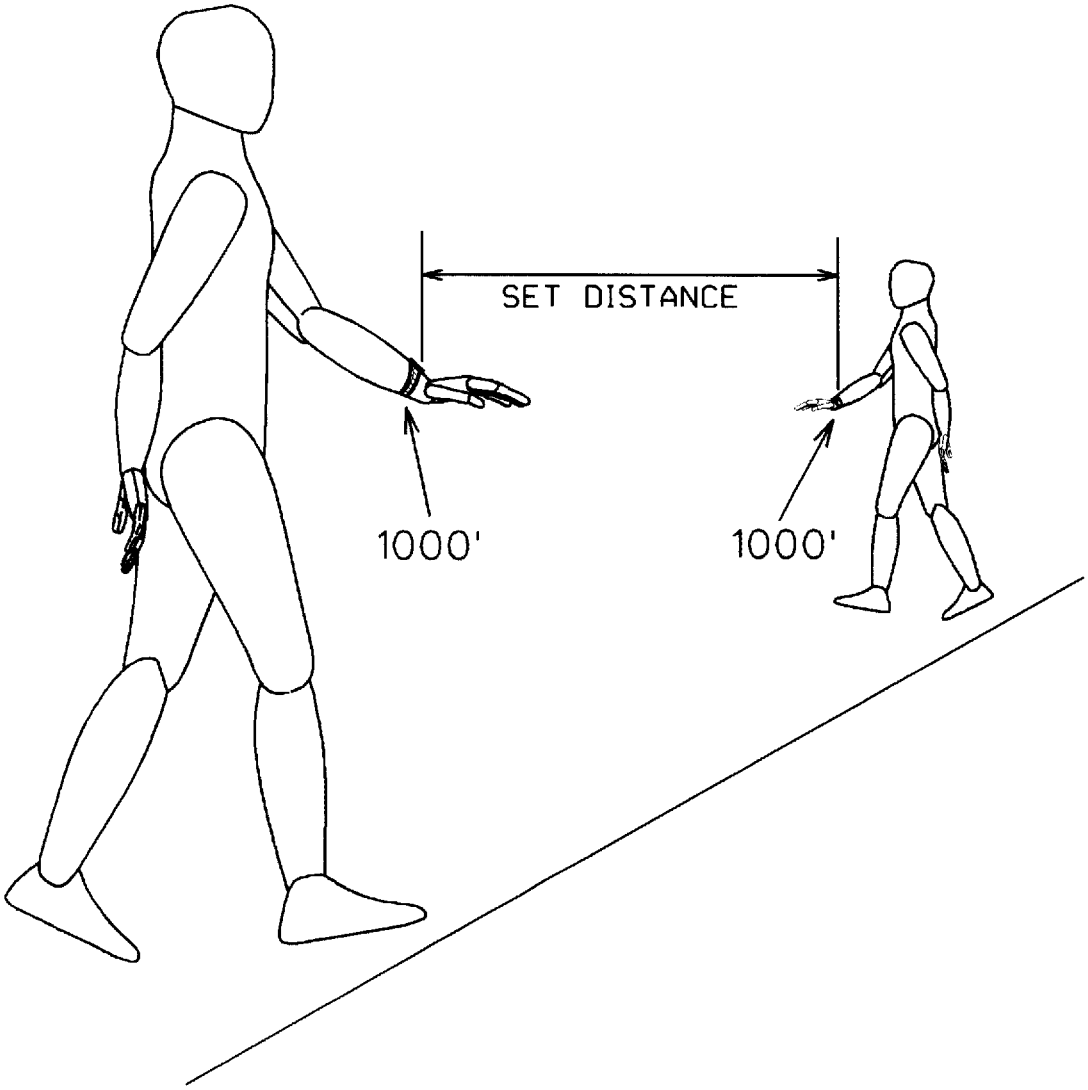
FIG. 4 is a diagrammatic view showing two users of the system.

As an option, upon setting the mode of the watch to the transmission mode by depression of mode button 1200, the preselected distance may be changed. Upon pressing the send/receive button 1400 a digital display will appear on the watch face as in FIG. 3. Subsequent depression of the button 1400 will change the preselected distance displayed as well as the strength of the base signal provided by limiter 160 to comparator 140'. It is understood that as the preselected distance increases the strength of the base signal must decrease. Thus, at 225 feet the strength of the limiting signal will be at a minimum such that the reduced signal received by the receiver 130' from transmitter 110 at distances greater than 225 feet will be less than this base signal so as to produce a control signal which will trigger the alarm 200. It is understood that the means for varying the signal strength of the signal limiter 160 is known in the art. Once set the start/stop button 1250 is depressed to start transmission/reception.

The watch may also employ an alternative panic button 1500 which, upon depression, will cause the transmitter 110 to cease transmission. Thus, as receiver 160' will sense no signal the alarm 200' in the other watch 1000' will sound.

Accordingly, it can be seen that as both watches 1000, 1000' are transmitting signals to each other a constant monitoring of the distance between the two individuals can be maintained without the need for one individual to remain immobile at a stationary base station. It is also understood that by adjustment of the preselected distance the monitor system can be used in various environments. For example, a preselected minimum distance may be used for a situation where monitoring is required in a crowded area as opposed to the maximum distance when monitoring is in an open environment such as in the park or the like is desired.

Moreover, the use of the watch-like monitor provides for a system which is readily worn by the child and monitored and is not embarrassing, annoying or otherwise difficult to wear.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. An alarm system comprising:

first and second watches for wear by first and second users, each watch having a transceiver assembly comprising:

transmitting means for sending a signal;

means for providing a periodic sending of said signals by said transmitting means;

receiver means for receiving said transmitted signals from the other watch;

means for powering said transmitting and receiving means;

signal producing means for producing a base signal indicative of a strength of a signal received by one watch if transmitted from the other watch at a preselected distance;

comparator means for comparing a signal transmitted by the other watch and received by said receiving means to said base signal produced in said watch receiving said signal, said comparator means producing a comparator signal upon a strength of said received signal from the other watch being less than a strength of said produced base signal;

a relay responsive to said produced comparator signal;

alarm means connected to said relay, a closure of said relay in response to said comparator signal connecting said power means to said alarm means, whereby to energize said alarm means, said energized alarm means indicative of one of said watches receiving a signal transmitted from the other watch from a distance beyond said preselected distance.

2. The device as claimed in claim 1 further comprising means for varying the strength of said base signal.

3. The device as claimed in claim 1 wherein said base signal decreases in value according to an increase in a said preselected distance of said watches.

4. The device as claimed in claim 1 further comprising means for reducing a strength of said received signal to less than said base signal, whereby to energize said alarm.

5. The device as claimed in claim 4 wherein said reducing means comprises a button on said watch to cease transmission of said signal, whereby said received signal strength is zero.

6. An alarm system comprising:

first and second housing for carrying by first and second users, each housing having a transceiver assembly comprising:

transmitting means for sending a signal;

receiver means for receiving a transmitted signal from the other assembly;

means for powering said transmitting and receiving means;

signal producing means for producing a base signal indicative of a strength of a signal received by one assembly if transmitted from another housing at a preselected distance, said signal producing means including means for varying the strength of said base signal;

comparator means for comparing a signal received by said receiving means to said base signal, said comparator means producing a comparator signal upon a strength of said received signal being less than a strength of said base signal;

a relay responsive to said comparator signal;

alarm means connected to said relay, a closure of said relay connecting said power means to said alarm means, whereby to energize said alarm means.

7. An alarm system comprising:

first and second housings for transport by first and second users, each housing having a transceiver assembly comprising:

transmitting means for sending a signal;

receiver means for receiving a transmitted signal from the other housing;

means for powering said transmitting and receiving means;

signal producing means for producing a base signal indicative of a strength of a signal received by one housing if transmitted from another housing at a preselected distance;

comparator means for comparing a signal received by said receiving means to said base signal, said comparator means producing a comparator signal upon a strength of said received signal being less than a strength of said base signal;

a relay responsive to said comparator signal;

a user-operable switch for closing said relay in the absence of said comparator signal;

alarm means connected to said relay, a closure of said relay by said comparator signal or said switch connecting said power means to said alarm means, whereby to energize said alarm means.

* * * * *